US011788738B2

(12) United States Patent
Shimomugi et al.

(10) Patent No.: US 11,788,738 B2
(45) Date of Patent: Oct. 17, 2023

(54) OUTDOOR UNIT AND AIR CONDITIONER

(71) Applicant: Mitsubishi Electric Corporation, Tokyo (JP)

(72) Inventors: Takuya Shimomugi, Tokyo (JP); Keisuke Mori, Tokyo (JP); Koichi Arisawa, Tokyo (JP); Satoru Ichiki, Tokyo (JP); Keisuke Uemura, Tokyo (JP); Kenji Iwazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 379 days.

(21) Appl. No.: 17/267,669

(22) PCT Filed: Aug. 29, 2018

(86) PCT No.: PCT/JP2018/032001

§ 371 (c)(1),
(2) Date: Feb. 10, 2021

(87) PCT Pub. No.: WO2020/044473

PCT Pub. Date: Mar. 5, 2020

(65) Prior Publication Data

US 2021/0156574 A1 May 27, 2021

(51) Int. Cl.

| | |
|---|---|
| ***F24F 1/22*** | (2011.01) |
| ***F24F 1/24*** | (2011.01) |
| ***F24F 1/16*** | (2011.01) |
| ***F24F 13/20*** | (2006.01) |

(52) U.S. Cl.

CPC ..... *F24F 1/22* (2013.01); *F24F 1/24* (2013.01); *F24F 1/16* (2013.01); *F24F 2013/207* (2013.01)

(58) Field of Classification Search

CPC ..... F24F 1/22; F24F 1/24; F24F 1/48; F24F 13/20

USPC ..... 62/259.2

See application file for complete search history.

(56) References Cited

U.S. PATENT DOCUMENTS

2021/0123612 A1 4/2021 Shimomugi et al.

FOREIGN PATENT DOCUMENTS

| | | | |
|---|---|---|---|
| CN | 202769837 | A | 3/2013 |
| CN | 105571014 | A | 5/2016 |
| CN | 111684209 | A | 9/2020 |
| JP | 2003-139352 | A | 5/2003 |

(Continued)

OTHER PUBLICATIONS

Office Action dated Jan. 4, 2023 issued in corresponding JP Patent Application No. 2020-539931 (and English translation).

(Continued)

*Primary Examiner* — Steve S Tanenbaum

(74) *Attorney, Agent, or Firm* — POSZ LAW GROUP, PLC

(57) ABSTRACT

An outdoor unit includes a housing that includes a front panel and a back panel facing the front panel. The outdoor unit further includes a bell mouth provided on the front panel and a heat dissipator that dissipates heat generated by electric components. A windward end surface and a leeward end surface of the heat dissipator are, when viewed from above, placed in a region between a virtual surface and the back panel, the virtual surface being a virtual surface that is in contact with an end of the bell mouth on a side of the back panel and is parallel to an inner surface of the front panel.

10 Claims, 7 Drawing Sheets

(56) References Cited

FOREIGN PATENT DOCUMENTS

| | | | | |
|---|---|---|---|---|
| JP | 2003139352 | A | * | 5/2003 |
| JP | 2009-299907 | A | | 12/2009 |
| JP | 2009299907 | A | * | 12/2009 |
| JP | 2013-137132 | A | | 7/2013 |
| JP | 2018-113321 | A | | 7/2018 |

OTHER PUBLICATIONS

Office Action dated Jan. 17, 2022 issued in corresponding CN Patent Application No. 201880096811.2 (and English translation).
International Search Report of the International Searching Authority dated Nov. 20, 2018 for the corresponding international application No. PCT/JP2018/032001 (and English translation).
Office Action dated Oct. 5, 2021 issued in corresponding JP Application No. 2020-539931 (and English translation).
Office Action dated Sep. 13, 2021 issued in corresponding CN Application No. 201880096811.2 (and English translation).
Decision of Refusal dated Apr. 12, 2022 in corresponding JP Patent Application No. 2020-539931 (with English machine translation).
Chinese decision of refusal with a full English machine translation (Chinese Application No. 201880096811.2, dated Apr. 21, 2022).

* cited by examiner

OUTDOOR UNIT AND AIR CONDITIONER

CROSS REFERENCE TO RELATED APPLICATION

This application is a U.S. national stage application of International Patent Application No. PCT/JP2018/032001 filed on Aug. 29, 2018, the disclosure of which is incorporated herein by reference.

TECHNICAL FIELD

The present invention relates to an outdoor unit and an air conditioner, the outdoor unit including a heat dissipator.

BACKGROUND

An outdoor unit disclosed in Patent Literature 1 includes: a housing with an outlet formed on a front panel; a heat exchanger, a compressor, and a blower provided in the housing; a control substrate provided in the housing and controlling the operation of the compressor and the blower; an electric component provided on the control substrate; and a heat dissipator for dissipating heat generated by the electric component. The outdoor unit further includes a partition board that partitions the space in the housing into a blower chamber and a compressor chamber, the blower chamber being a space where the blower is arranged, and the compressor chamber being a space where the compressor is arranged. The heat dissipator includes a base thermally connected to the electric component, and a plurality of fins provided on the base. An air guide is provided on the side of tips of the plurality of fins, and the space surrounded by the base, the plurality of fins, and the air guide forms an air passage. According to the outdoor unit disclosed in Patent Literature 1, even when the heat dissipator is provided near a blower fan having a relatively small amount of ventilation, the entire heat dissipator is cooled efficiently by allowing air to flow through the air passage formed in the heat dissipator.

PATENT LITERATURE

Patent Literature 1: Japanese Patent Application Laid-open No. 2009-299907

However, when a bell mouth is provided around the outlet of the housing of the outdoor unit disclosed in Patent Literature 1, a closed space surrounded by an outer peripheral surface of the bell mouth, an inner surface of the front panel, and the partition board is formed in the housing. The bell mouth is an annular member that projects from an annular wall surface forming the outlet into the housing so as to reduce a pressure loss when the air having passed through the machine heat exchanger and flowed into an air blowing chamber is discharged to the outside of the air blowing chamber through the outlet. In this closed space, the pressure tends to be high because the air flow is more stagnant therein than in the space outside the closed space. Therefore, when leeward end surfaces of the fins lie in the closed space, the air having entered the air passage formed between the adjacent fins from windward end surfaces of the fins flows toward the tips of the fins, that is, ends of the fins on the side opposite to the side of the base, before reaching the leeward end surfaces of the fins. Such a change in the direction of flow of the air having entered the air passage causes a decrease in the velocity of flow of the air at the leeward end surfaces of the fins, so that the cooling capacity of the heat dissipator cannot be sufficiently achieved.

SUMMARY

The present invention has been made in view of the above, and an object of the present invention is to provide an outdoor unit in which the cooling capacity of a heat dissipator can be improved even when a bell mouth is provided in a housing.

An outdoor unit according to an aspect of the present invention includes a housing that includes a front panel having an outlet for an airflow, a back panel facing the front panel, a left side panel, a right side panel facing the left side panel, a bottom panel, and a top panel facing the bottom panel. The outdoor unit further includes a bell mouth that has an annular shape, is provided on the front panel, and projects from a rim of a circular opening forming the outlet, a control substrate that is provided in the housing and provided with an electric component, and a heat dissipator that dissipates heat generated by the electric component. A windward end surface and a leeward end surface of the heat dissipator are, when viewed from above, placed in a region between a virtual surface and the back panel, the virtual surface being a virtual surface that is in contact with an end of the bell mouth on a side of the back panel and is parallel to an inner surface of the front panel.

The outdoor unit according to the present invention has an effect that the cooling capacity of the heat dissipator can be improved even when the bell mouth is provided in the housing.

DETAILED DESCRIPTION

An outdoor unit and an air conditioner according to embodiments of the present invention will now be described in detail with reference to the drawings. Note that the present invention is not limited to the embodiments.

First Embodiment

Figure 1:
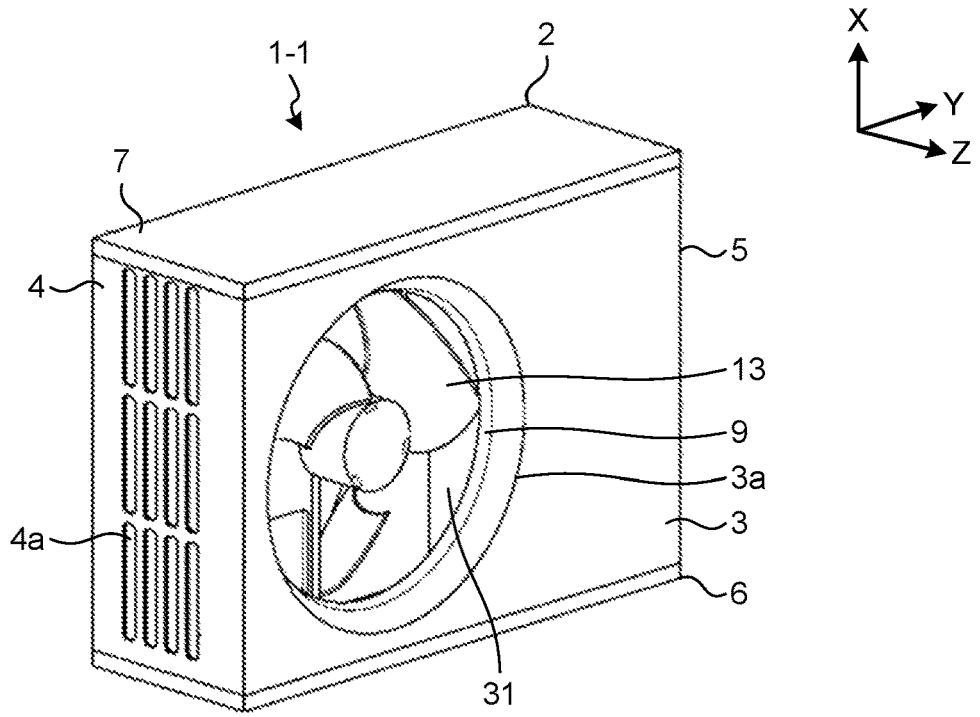
FIG. 1 is an external view of an outdoor unit according to a first embodiment of the present invention.
Figure 2:
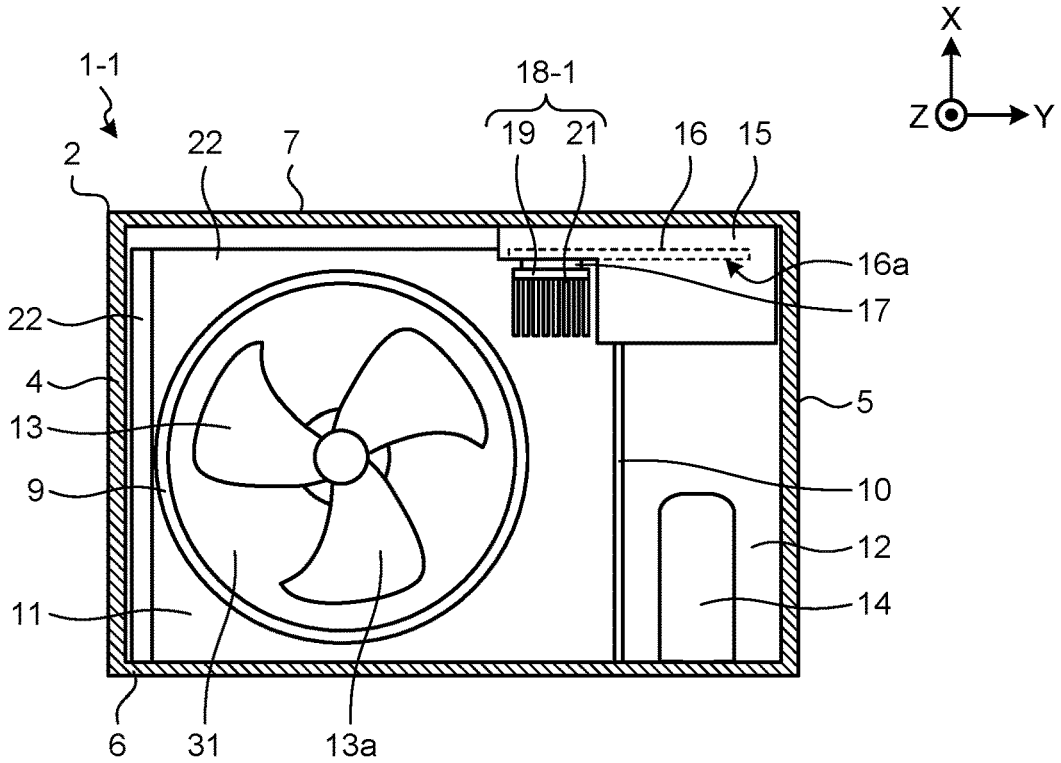
FIG. 2 is an internal view of the outdoor unit illustrated in FIG. 1 as viewed from the front.
Figure 3:
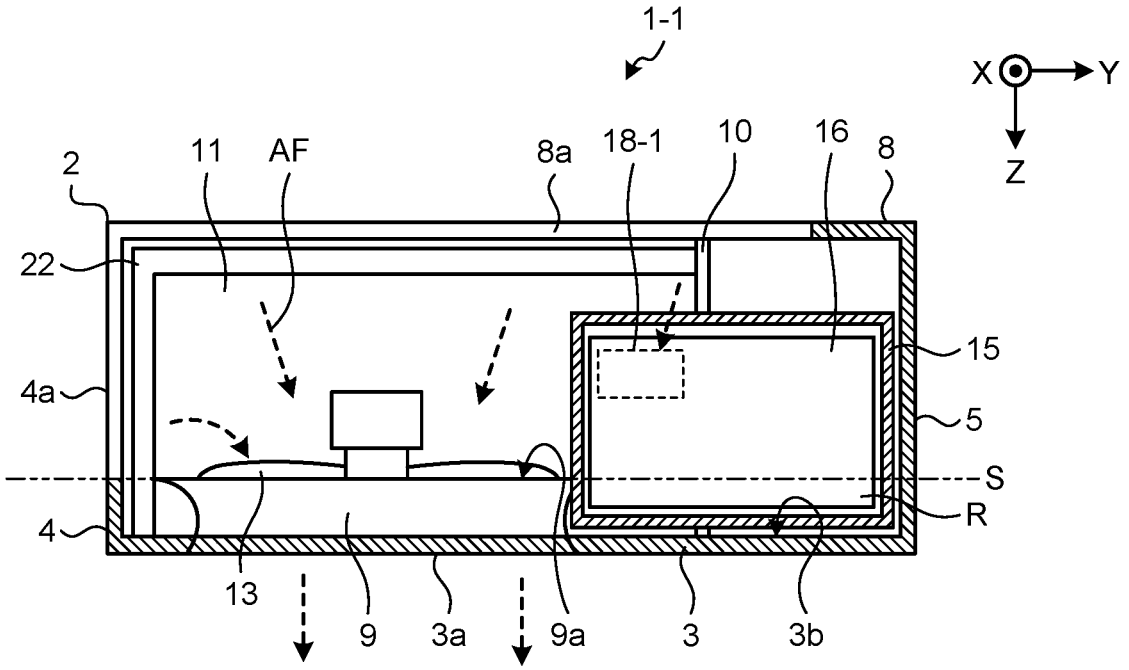
FIG. 3 is an internal view of the outdoor unit illustrated in FIG. 1 as viewed from above.

First, an overview of the configuration of an outdoor unit 1-1 according to a first embodiment of the present invention will be described with reference to FIGS. 1 to 3. FIG. 1 is an external view of the outdoor unit according to the first embodiment of the present invention. FIG. 2 is an internal view of the outdoor unit illustrated in FIG. 1 as viewed from the front. FIG. 3 is an internal view of the outdoor unit illustrated in FIG. 1 as viewed from above. The outdoor unit 1-1 is an outdoor unit of an air conditioner. The air conditioner uses a refrigerant circulating between the outdoor unit 1-1 and an indoor unit placed in a room to transfer heat between the indoor air and the outdoor air, and perform air conditioning of the room. The outdoor unit 1-1 includes a housing 2 that forms an outer shell of the outdoor unit 1-1. The outdoor unit 1-1 further includes a blower 13, a bell mouth 9, a compressor 14, a partition board 10, a control substrate 16, a heat dissipator 18-1, an electric component box 15, and a heat exchanger 22 that are provided inside the housing 2. FIGS. 1 to 3 use left-handed XYZ coordinates to define a direction along the vertical width of the outdoor unit 1-1 as an X axis direction, a direction along the horizontal width of the outdoor unit 1-1 as a Y axis direction, and a direction along the depth of the outdoor unit 1-1 as a Z axis direction. The axial directions similar to the above are also applied to FIG. 4 and the following drawings.

The housing 2 includes a front panel 3 that forms a front surface of the housing 2, a back panel 8 that faces the front panel 3 and forms a back surface of the housing 2, a left side panel 4 that forms a side surface on the left side of the housing 2 when the housing 2 is viewed from the front, a right side panel 5 that faces the left side panel 4, a bottom panel 6 that forms a bottom surface of the housing 2, and a top panel 7 that faces the bottom panel 6. Note that the front panel 3 and the left side panel 4 may be formed by one component.

An inlet 4*a* is formed on the left side panel 4. An inlet 8*a* is formed on the back panel 8. The inlet 4*a* and the inlet 8*a* are for taking air from the outside of the housing 2 into the housing 2.

An outlet 31 of a circular shape is formed on the front panel 3. The outlet 31 is an opening for discharging the air taken into the housing 2 to the outside of the housing 2. The bell mouth 9 is provided on a wall surface 3*a* having an annular shape and forming the outlet 31. The bell mouth 9 is an annular member projecting from the wall surface 3*a* into the housing 2.

Inside the housing 2, the blower 13 is arranged within a region that is obtained by projecting an inner edge of the bell mouth 9 from the front panel 3 of the housing 2 toward the back panel 8 thereof. The blower 13 includes an impeller 13*a* and a motor 13*b* that is a power source for the impeller 13*a*. When the motor 13*b* of the blower 13 is driven to cause the impeller 13*a* of the blower 13 to rotate, air is taken into a blower chamber 11 of the housing 2 through the inlets 4*a* and 8*a*. The air taken into the blower chamber 11 is discharged to the outside of the housing 2 through the outlet 31. In FIG. 3, a broken arrow indicates an airflow AF generated inside the housing 2 due to the rotation of the blower 13. The airflow AF is a flow of the air taken into the blower chamber 11 of the housing 2 from the outside of the housing 2.

The partition board 10 is a member that partitions the space in the housing 2 into the blower chamber 11 and a compressor chamber 12, the blower chamber 11 being a space where the blower 13 is arranged, and the compressor chamber 12 being a space where the compressor 14 is arranged. The blower chamber 11 is the space surrounded by the front panel 3, the left side panel 4, the bottom panel 6, the top panel 7, the back panel 8, and the partition board 10. The compressor chamber 12 is the space surrounded by the front panel 3, the right side panel 5, the bottom panel 6, the electric component box 15, the back panel 8, and the partition board 10. When the outdoor unit 1-1 is viewed from the front, for example, the partition board 10 extends from the bottom panel 6 toward the top panel 7 and comes into contact with a lower surface of the electric component box 15 before reaching the top panel 7.

The compressor chamber 12 is the space surrounded by the partition board 10 and the right side panel 5. The compressor chamber 12 is provided with the compressor 14 for compressing the refrigerant. The compressor 14 is connected to a plurality of pipes (not shown) included in the heat exchanger 22, and the refrigerant compressed by the compressor 14 is sent to the pipes. When air passes through the heat exchanger 22, heat exchange occurs between the refrigerant flowing through the pipes and the heat exchanger 22.

The heat exchanger 22 is provided inside the housing 2 so as to cover the inlets 4*a* and 8*a*. The heat exchanger 22 is provided in the blower chamber 11 and faces the inside of each of the back panel 8 and the left side panel 4 of the housing 2. When the outdoor unit 1-1 is viewed from above, for example, the heat exchanger 22 has an L-shape extending from the left side panel 4 toward the back panel 8. The heat exchanger 22 includes a plurality of heat dissipating fins (not shown) arranged apart from one another, and the plurality of pipes (not shown) provided to pass through the plurality of heat dissipating fins and allowing the refrigerant to flow through the pipes.

The electric component box 15 is provided above the compressor chamber 12. The electric component box 15 is provided in a space formed between an upper end of the partition board 10 and the top panel 7. The electric component box 15 is for controlling components of the air conditioner, and is arranged over the blower chamber 11 and the compressor chamber 12.

The electric component box 15 houses the control substrate 16 on which a plurality of electric components 17 is provided. The control substrate 16 is a plate-shaped member extending from the right side panel 5 toward the left side panel 4. The electric components 17 are provided on a substrate surface 16*a* of the control substrate 16. The substrate surface 16*a* is a surface of the control substrate 16 on the side of the bottom panel 6. The electric component 17 is, for example, a semiconductor element, a reactor, or the like constituting an inverter circuit that converts direct current power into alternating current power and drives at least one of the compressor 14 and the blower 13. The electric component 17 is not limited to the semiconductor element or the reactor forming the inverter circuit and may be, for example, a resistor for voltage detection, a smoothing capacitor, or a semiconductor element forming a converter circuit that converts alternating current power supplied from a commercial power source into direct current power and outputs it to an inverter circuit.

Each of the plurality of electric components 17 is in contact with a heat dissipator 18-1 as illustrated in FIG. 2. The heat dissipator 18-1 is a component for cooling each of the plurality of electric components 17. The heat dissipator 18-1 may be fixed to the electric components 17, or may be fixed to the control substrate 16 or the electric component box 15 via a fixing member (not shown). The heat dissipator 18-1 is provided below the control substrate 16 and in the blower chamber 11. The heat dissipator 18-1 is arranged outside a region obtained by projecting an inner edge of the bell mouth 9 from the front panel 3 of the housing 2 toward the back panel 8 thereof.

Figure 4:
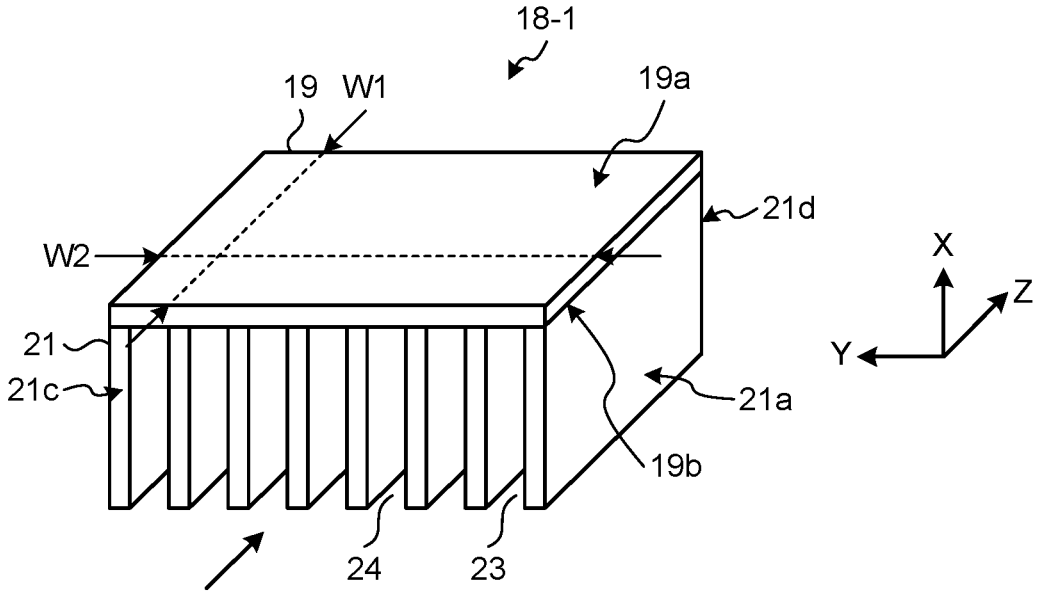
FIG. 4 is a perspective view of the heat dissipator illustrated in FIGS. 2 and 3.
Figure 5:
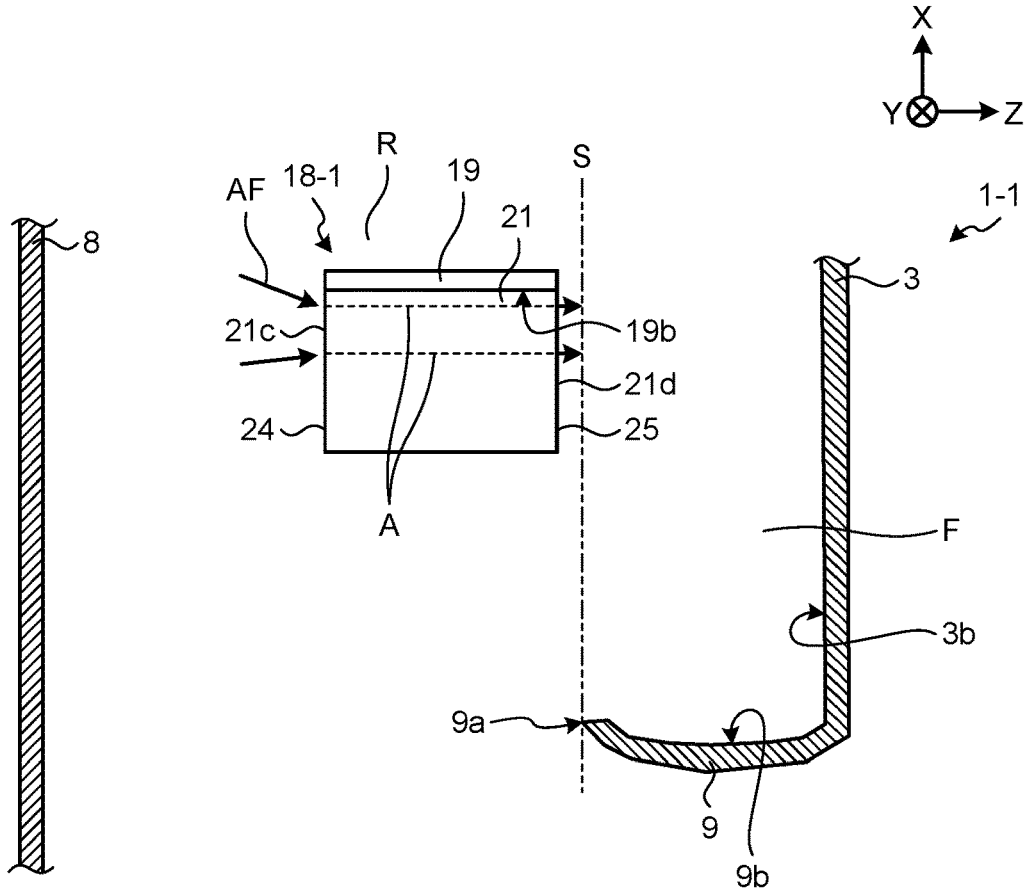
FIG. 5 is a diagram illustrating an arrangement relationship among a back panel, the heat dissipator, and a bell mouth when the heat dissipator illustrated in FIGS. 2 and 3 is viewed from a left side panel toward a right side panel.
Figure 6:
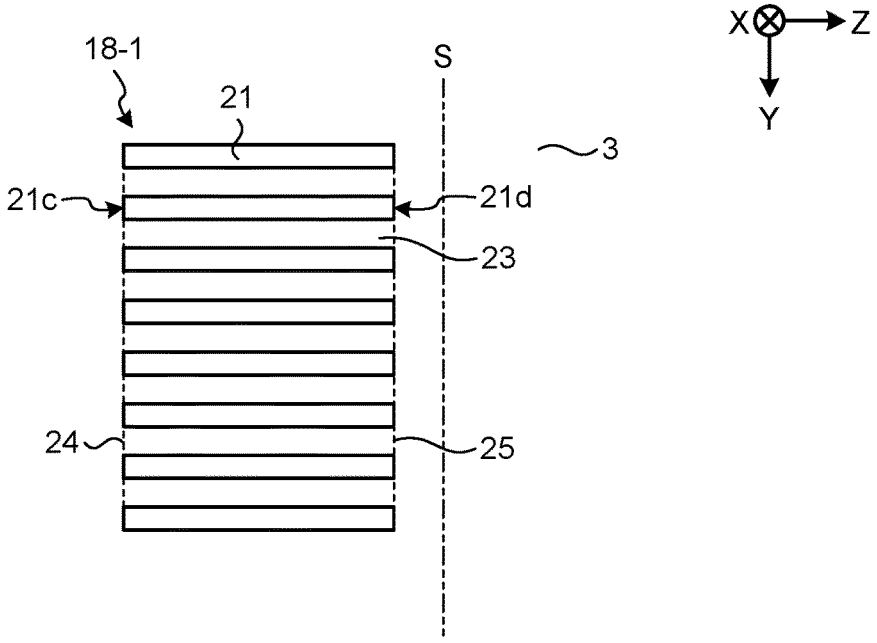
FIG. 6 is a diagram illustrating a state in which the heat dissipator illustrated in FIG. 5 is viewed from a bottom panel toward a top panel.

Next, a configuration of the heat dissipator 18-1 will be described with reference to FIGS. 4 to 6. FIG. 4 is a perspective view of the heat dissipator illustrated in FIGS. 2 and 3. FIG. 4 illustrates the appearance of the heat dissipator when the heat dissipator illustrated in FIGS. 2 and 3 is viewed from the back panel. FIG. 5 is a diagram illustrating an arrangement relationship among the back panel, the heat dissipator, and the bell mouth when the heat dissipator illustrated in FIGS. 2 and 3 is viewed from the left side panel toward the right side panel. FIG. 6 is a diagram illustrating a state in which the heat dissipator illustrated in FIG. 5 is viewed from the bottom panel toward the top panel. In the following, a side of the heat dissipator 18-1 corresponding to the back panel 8 will be referred to as a windward side, and a side of the heat dissipator 18-1 corresponding to the front panel 3 will be referred to as a leeward side.

As illustrated in FIG. 4, the heat dissipator 18-1 includes a base 19 and a plurality of fins 21 provided on the base 19. The base 19 is a rectangular plate-shaped member with a width W1 along a direction from the front panel 3 to the back panel 8 being narrower than a width W2 along a direction from the right side panel 5 to the left side panel 4. Note that the shape of the base 19 is not limited to the rectangle as long as the base 19 can transfer heat, which is transferred from the plurality of electric components 17 to the base 19, to the plurality of fins 21.

An upper surface 19*a* of the base 19 is in contact with the electric components 17 illustrated in FIG. 2. A lower surface 19*b* of the base 19 is provided with the plurality of fins 21. Each of the plurality of fins 21 is a plate-shaped member extending toward a lower part of the housing 2 from the lower surface 19*b* of the base 19. The plurality of fins 21 is arranged apart from one another in the Y axis direction.

Each of the plurality of fins 21 includes heat dissipating surfaces 21*a*. The heat dissipating surface 21*a* is a surface facing the adjacent one of the fins 21. The heat dissipating surface 21*a* has a rectangular shape, for example. Note that the shape of the fin 21 is not limited to the rectangle as long as the fin 21 can dissipate the heat, which is transferred from the base 19 to the fin 21, to the air. The heat dissipating surfaces 21*a* are parallel to the left side panel 4 and the right side panel 5 illustrated in FIG. 1. An air passage 23 through which air passes is formed in a gap between the heat dissipating surfaces 21*a* of the fins 21 adjacent to each other.

One end surface of each of the plurality of fins 21 in the Z axis direction forms a windward end surface 21*c*. A plurality of the windward end surfaces 21*c* corresponds to a windward end surface of the heat dissipator 18-1. An inlet 24 for allowing air to flow into the air passage 23 is formed in the gap between adjacent ones of the windward end surfaces 21*c*.

Another end surface of each of the plurality of fins 21 in the Z axis direction forms a leeward end surface 21*d*. A plurality of the leeward end surfaces 21*d* corresponds to a leeward end surface of the heat dissipator 18-1. An outlet 25 for discharging air passing through the air passage 23 is formed in the gap between the adjacent ones of the leeward end surfaces 21*d*.

As illustrated in FIGS. 5 and 6, the inlet 24 and the outlet 25 are placed in a region R on the windward side relative to a virtual surface S. The virtual surface S is a virtual surface in contact with an end 9*a* of the bell mouth 9 on the side of the back panel 8, parallel to an inner surface 3*b* of the front panel 3, and extending from the bell mouth 9 to each of the top panel 7, the bottom panel 6, the right side panel 5, and the left side panel 4. The region R is the space between the virtual surface S and the back panel 8. As described above, both the windward end surfaces 21*c* and the leeward end surfaces 21*d* of the heat dissipator 18-1 are placed in the region R. Reference character "F" illustrated in FIG. 5 indicates a closed space formed inside the housing 2. The closed space F is a space surrounded by an outer peripheral surface 9*b* of the bell mouth 9, the inner surface 3*b* of the front panel 3, and the partition board 10 illustrated in FIG. 2.

Next, the flow of air in the heat dissipator 18-1 will be described. Note that for the purpose of facilitating the understanding of an effect of the heat dissipator 18-1, a configuration of a heat dissipator according to a comparison example will be described first, and then the flow of air in the heat dissipator 18-1 according to the first embodiment will be described.

Figure 7:
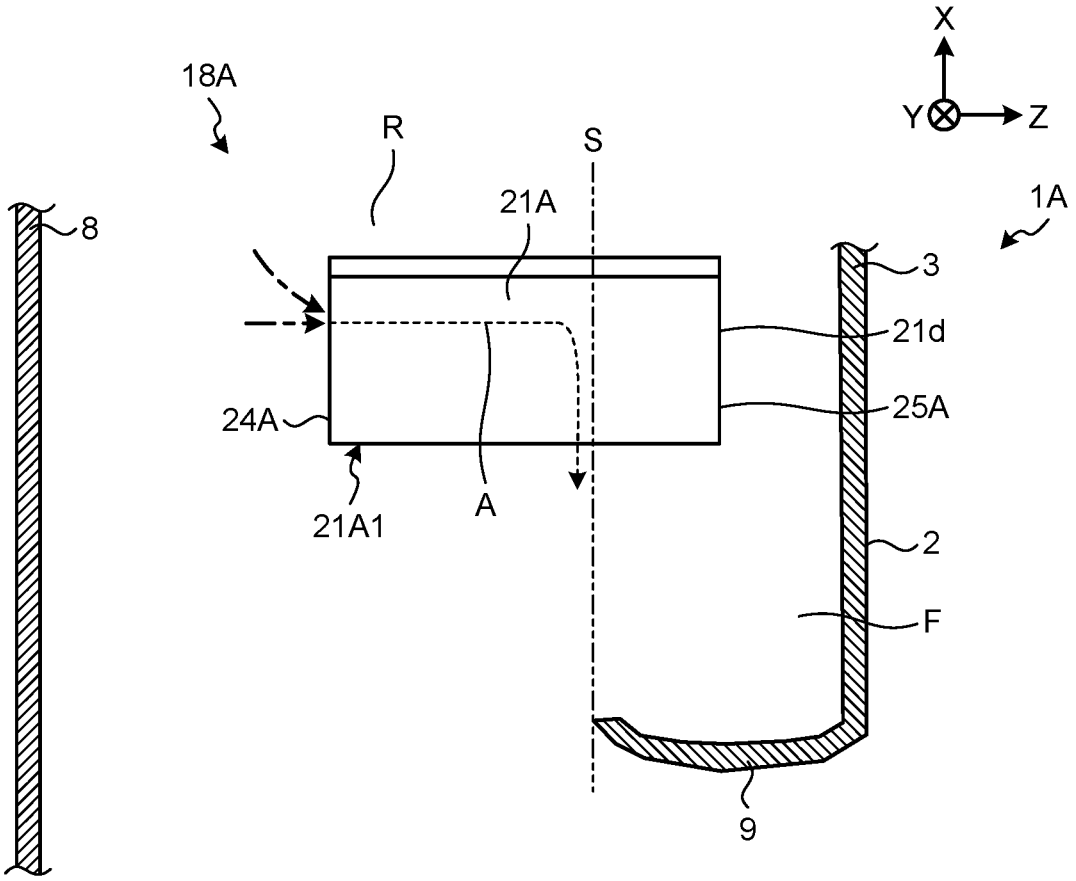
FIG. 7 is an enlarged diagram schematically illustrating a heat dissipator provided in an outdoor unit according to a comparison example.

FIG. 7 is an enlarged diagram schematically illustrating a heat dissipator provided in an outdoor unit according to a comparison example. In an outdoor unit 1A illustrated in FIG. 7, an outlet 25A of a heat dissipator 18A is provided on the side of the front panel 3 relative to the virtual surface S. Also, because an outdoor unit 1A includes the bell mouth 9, the closed space F is formed inside the housing 2 of the outdoor unit 1A.

The flow of air in the heat dissipator 18A will be described. When the airflow AF is generated by the rotation of the blower 13, the air on the windward side of the heat dissipator 18A flows into the air passage formed by fins 21A from an inlet 24A of the heat dissipator 18A. Here, because the closed space F is formed inside the housing of the outdoor unit 1A, the flow of the air is stagnant in the closed space F. When the flow of the air becomes stagnant in the closed space F, the pressure in the closed space F tends to be higher than the pressure in the space outside the closed space F. Therefore, when the outlet 25A of the heat dissipator 18A lies in the closed space F, air A that has entered the air passage of the fins 21A flows toward ends 21A1 of the fins before reaching the outlet 25A of the heat dissipator 18A. Such a change in the direction of flow of the air A having entered the air passage causes a decrease in the velocity of flow of the air A at the outlet 25A of the heat dissipator 18A, so that the cooling capacity of the heat dissipator 18A cannot be sufficiently achieved.

On the other hand, in the heat dissipator 18-1 according to the first embodiment, the leeward end surfaces 21*d* are arranged on the windward side relative to the virtual surface S, so that the retention of the air as in the closed space F does not occur in the space between the leeward end surfaces 21*d* and the virtual surface S. Accordingly, the air A that has entered the air passage 23 of the fins 21 is discharged from the outlet 25 of the heat dissipator 18-1. As a result, the velocity of flow of the air A passing through the air passage 23 of the fins 21 is increased as compared to that through the heat dissipator 18A illustrated in FIG. 7, and the cooling efficiency of the heat dissipator 18-1 is improved. Therefore, the cooling capacity of the heat dissipator 18-1 can be sufficiently achieved without increasing the width of the heat dissipator 18-1 in the Z axis direction in order to improve the cooling efficiency. As a result, the amount of material used to form the fins 21 is reduced as compared to the heat dissipator 18A illustrated in FIG. 7, whereby the cost of manufacturing the heat dissipator 18-1 can be reduced.

Moreover, according to the outdoor unit 1-1 of the first embodiment, the cooling efficiency of the heat dissipator 18-1 is improved so that the electric components 17 provided on the control substrate 16 are efficiently cooled. The efficient cooling of the electric components 17 can extend the life of the control substrate 16 and the electric components 17. The outdoor unit 1-1 according to the first embodiment can also extend the life of another component not in contact with the heat dissipator 18-1. For example, in a case where the other component is an electrolytic capacitor, the electrolytic capacitor is a component that is easily affected by the ambient temperature because it contains an electrolyte solution. Being affected by the ambient temperature, the life of the electrolytic capacitor is roughly doubled when the ambient temperature drops by 10° C. The efficient cooling of the electric components 17 can prevent or reduce an increase in the ambient temperature as well. Preventing or reducing the increase in the ambient temperature can prevent or reduce the influence of heat on the other component not in contact with the heat dissipator 18-1, and can significantly extend the life thereof.

When the electric components 17 are downsized, the heat dissipation area of the electric components 17 is reduced, and the heat dissipation efficiency thereof is decreased. According to the outdoor unit 1-1 of the first embodiment, the electric components 17 are in contact with the heat dissipator 18-1 whose cooling efficiency is improved, and thus the decrease in the heat dissipation efficiency of the electric components 17 itself can be compensated for. As a result, the downsizing can be achieved while reducing heat generation of the reactor and the semiconductor element provided as some of the electric components 17, for example.

Figure 8:
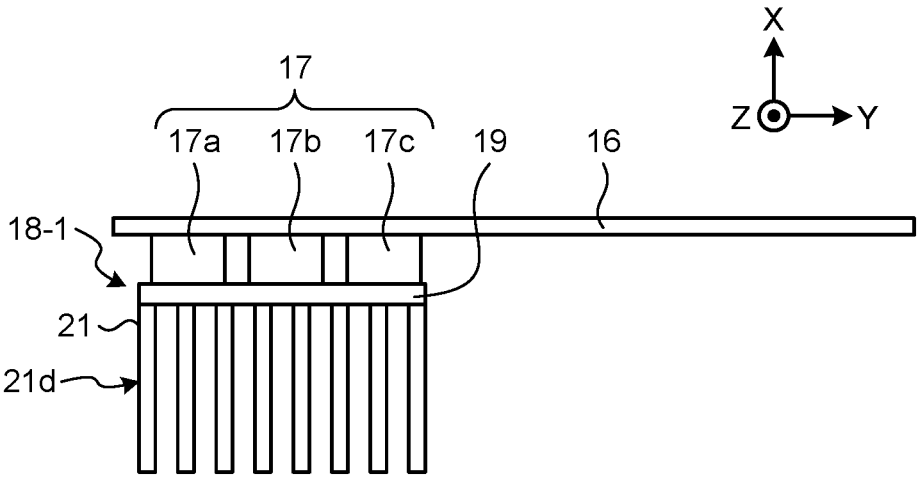
FIG. 8 is a diagram illustrating a control substrate on which a plurality of electric components is arranged side by side along a direction of arrangement of a plurality of fins illustrated in FIG. 4.

FIG. 8 is a diagram illustrating the control substrate on which the plurality of electric components is arranged side by side along the direction of arrangement of the plurality of fins illustrated in FIG. 4. As illustrated in FIG. 8, the plurality of electric components 17 is arranged apart from one another in the Y axis direction. That is, the plurality of electric components 17 is arranged in the same direction as the direction of arrangement of the plurality of fins 21. The plurality of electric components 17 includes, for example, a first electric component 17*a*, a second electric component 17*b*, and a third electric component 17*c*. Each of the first electric component 17*a*, the second electric component 17*b*, and the third electric component 17*c* is in contact with the base 19 of the heat dissipator 18-1.

Compared to a case where the plurality of electric components 17 is arranged in the Z axis direction, when the plurality of electric components 17 is arranged in the Y axis direction as described above, the heat generated by the plurality of electric components 17 is easily distributed to the plurality of fins 21 so that the plurality of electric components 17 can be effectively cooled.

Moreover, the plurality of electric components 17 is arranged in the Y axis direction so that, as compared to the case where the plurality of electric components 17 is arranged in the Z axis direction, the heat generated by the first electric component 17*a* is less easily transferred to the second electric component 17*b* that has a lower allowable temperature than the first electric component 17*a* even when the first electric component 17*a* has the highest amount of heat generated, and that it is possible to prevent the second electric component 17*b* from getting hot and failing.

Moreover, when the first electric component 17*a*, the second electric component 17*b*, and the third electric component 17*c* are arranged in the order of the first electric component 17*a*, the second electric component 17*b*, and the third electric component 17*c* from the windward side to the leeward side, the heat generated by the first electric component 17*a* and the second electric component 17*b* causes the temperature of certain ones of the plurality of fins 21 to be higher than the temperature of the rest of the fins 21. Therefore, the heat generated by the third electric component 17*c* on the leeward side is less easily absorbed by the fins. On the other hand, when the first electric component 17*a*, the second electric component 17*b*, and the third electric component 17*c* are arranged in the Y axis direction as illustrated in FIG. 8, the heat generated by the third electric component 17*c* on the leeward side is absorbed by the fins 21 provided corresponding to the third electric component 17*c* without being affected by the heat generated in the first electric component 17*a* and the second electric component 17*b*. Therefore, the third electric component 17*c* on the leeward side can be effectively cooled.

Figure 9:
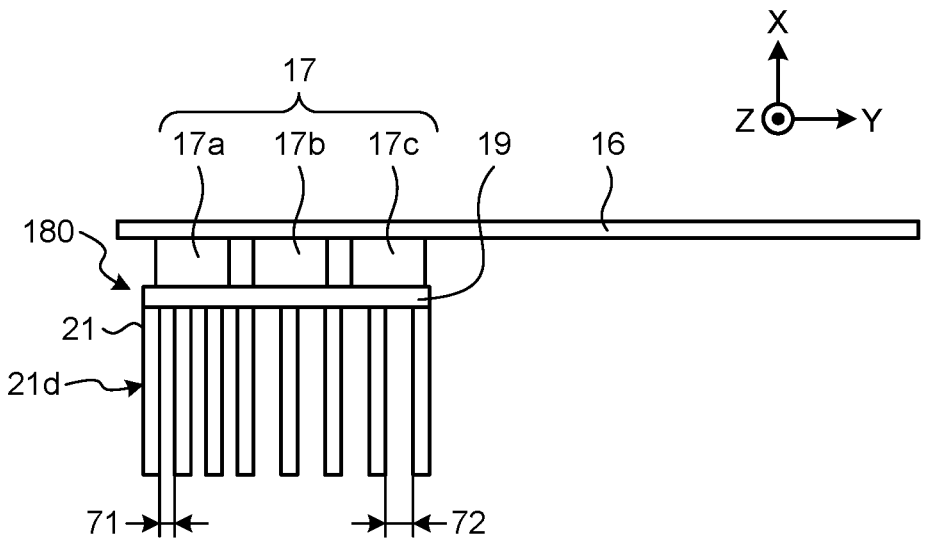
FIG. 9 is a diagram illustrating a variation of the heat dissipator illustrated in FIG. 8.

FIG. 9 is a diagram illustrating a variation of the heat dissipator illustrated in FIG. 8. When the first electric component 17*a* with the highest amount of heat generated and the second electric component 17*b* and the third electric component 17*c* each with a lower amount of heat generated than the first electric component 17*a* are arranged in the Y axis direction, for example, a heat dissipator 180 according to the variation illustrated in FIG. 9 is formed such that a first fin pitch 71 of the plurality of fins 21 provided corresponding to the first electric component 17*a* is narrower than a second fin pitch 72 of the plurality of fins 21 provided corresponding to the second electric component 17*b* and the third electric component 17*c*.

When the first electric component 17*a* is a semiconductor element formed by a wide bandgap semiconductor, the wide bandgap semiconductor has higher heat resistance performance and higher switching speed than a silicon semiconductor. Therefore, the reactor, the motor, and the like can be downsized by operating the first electric component 17*a* at a high frequency. However, the heat generated by the wide bandgap semiconductor may have a higher value than the heat generated by the silicon semiconductor depending on the frequency, so that the first electric component 17*a* needs to be sufficiently cooled.

Also, the reactor being downsized can be provided on the control substrate 16. When the reactor is thus provided on the control substrate 16, it is necessary to reduce the influence of the heat generated by the reactor on a component existing around the reactor, and to prevent solder used for connecting reactor terminals to the control substrate 16 from melting due to the heat generated by the reactor. Therefore, when the reactor is provided on the control substrate 16, it is necessary to sufficiently cool the reactor and to prevent or reduce an increase in the temperature of the reactor as compared to a case where the reactor is installed in a place other than the control substrate 16.

According to the heat dissipator 180 illustrated in FIG. 9, the first fin pitch 71 is narrower than the second fin pitch 72 so that the heat dissipation area of the fins 21 provided corresponding to the first electric component 17*a* is increased, and that the cooling efficiency of the heat dissipator 180 can be improved. As a result, the life of the first electric component 17*a* can be extended. Moreover, the amount of material used to form the fins 21 is reduced as compared to a case where all the fins 21 are arranged at the first fin pitch 71, whereby the cost of manufacturing the heat dissipator 180 can be reduced.

Also, in a case where an electrolytic capacitor is provided as a component not in contact with the heat dissipator 180, as described above, the life of the electrolytic capacitor is roughly doubled when the ambient temperature drops by 10° C. Even when such a component easily affected by the ambient temperature is used, the heat dissipator 180 illustrated in FIG. 9 can significantly extend the life of the component not in contact with the heat dissipator 180.

Second Embodiment

Figure 10:
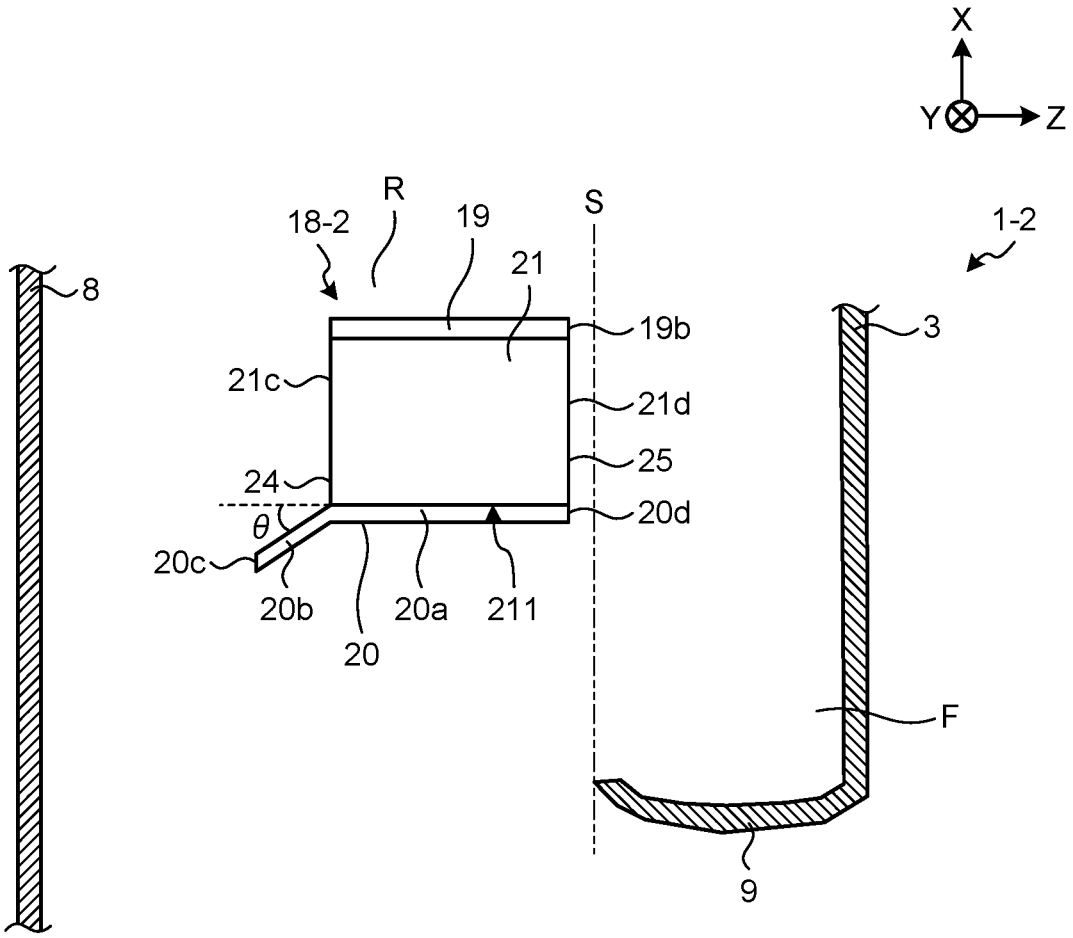
FIG. 10 is a diagram of a configuration of a heat dissipator included in an outdoor unit according to a second embodiment of the present invention.

FIG. 10 is a diagram of a configuration of a heat dissipator included in an outdoor unit according to a second embodiment of the present invention. An outdoor unit 1-2 according to the second embodiment includes a heat dissipator 18-2 instead of the heat dissipator 18-1. The heat dissipator 18-2 includes a deflector plate 20 in addition to the base 19 and the fins 21. The deflector plate 20 includes a flat surface portion 20*a* of a plate shape provided on an end surface 211 of the fins 21 and parallel to a YZ plane, and an inclined portion 20*b* provided at an end of the flat surface portion 20*a* on the windward side. The flat surface portion 20*a* and the inclined portion 20*b* may be integrally manufactured using a metal material, or may be individually manufactured and joined.

An end of the flat surface portion 20*a* on an opposite side of the inclined portion 20*b* forms a leeward end surface 20*d*. The position of the leeward end surface 20*d* in the Z axis direction is the same as the position of the leeward end surfaces 21*d* of the fins 21 in the Z axis direction.

The inclined portion 20*b* functions as a first guide piece that guides the airflow AF generated in the housing 2 to the inlet 24 of the heat dissipator 18-2. The inclined portion 20*b* is a surface that is inclined at a certain angle θ toward the bottom panel 6 with respect to the Z axis direction. The certain angle θ is an arbitrary angle from 1° to 89°, for example. A tip of the inclined portion 20*b* forms a windward end surface 20*c*. The windward end surface 20*c* is provided on the windward side relative to the windward end surfaces 21*c* of the plurality of fins 21.

The flat surface portion 20*a* functions as a second guide piece that guides the air introduced into the air passage 23 surrounded by the base and the fins through the inlet 24 to the outlet 25.

In the heat dissipator 18-2, the air passage 23 is formed by the space surrounded by the base 19, the fins 21 adjacent to each other, and the flat surface portion 20*a*.

According to the heat dissipator 18-2 illustrated in FIG. 10, the inclined portion 20*b* of the deflector plate 20 is provided at the inlet 24 of the heat dissipator 18-2, whereby the amount of air taken into the inlet 24 of the heat dissipator 18-2 is increased as compared to a case where the inclined portion 20*b* is not provided. Moreover, according to the heat dissipator 18-2, the flat surface portion 20*a* of the deflector plate 20 is provided on the end surface 211 of the fins 21, whereby the air taken into the air passage 23 of the heat dissipator 18-2 is guided to the outlet 25 of the heat dissipator 18-2 without flowing out to the side of the end surface 211 of the fins 21. Therefore, in the heat dissipator 18-2, the velocity of flow of the air flowing from the inlet 24 to the outlet 25 of the heat dissipator 18-2 is faster than that flowing through the heat dissipator 18-1 illustrated in FIG. 5, and the cooling efficiency of the electric components 17 in contact with the heat dissipator 18-2 is further improved.

Figure 11:
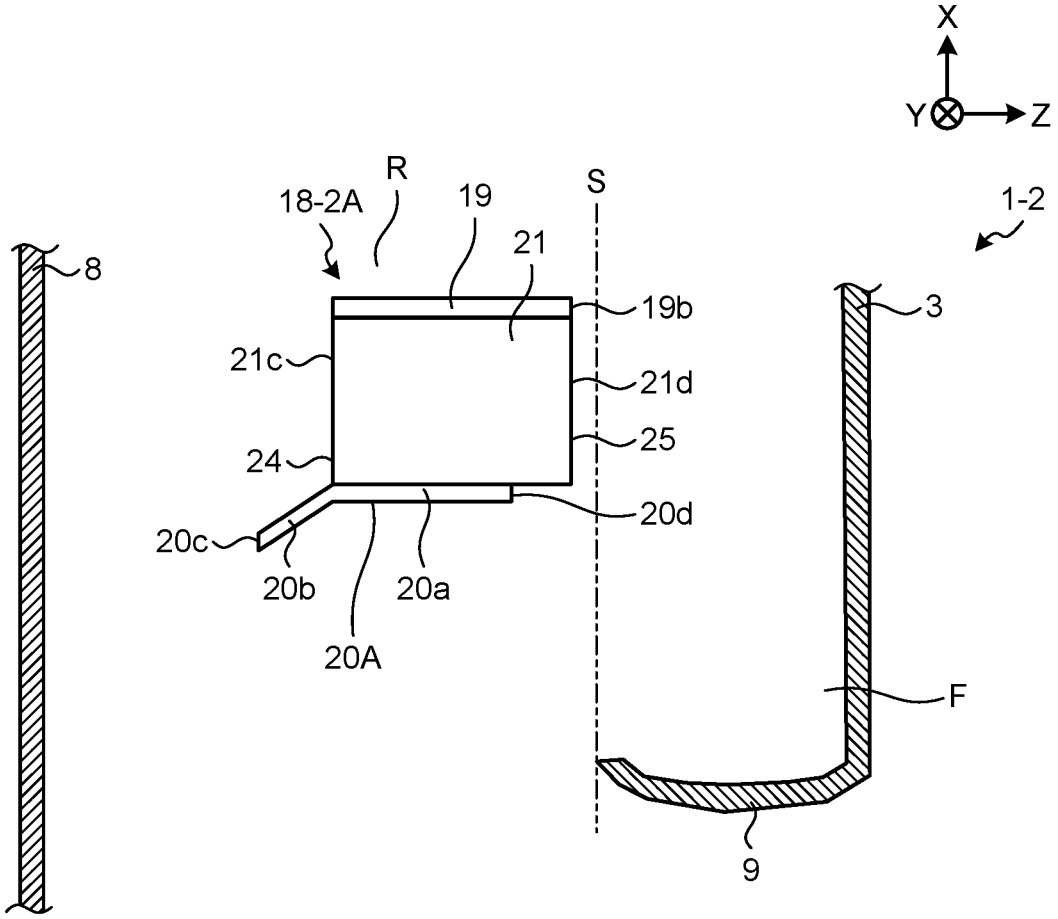
FIG. 11 is a diagram illustrating a variation of the heat dissipator illustrated in FIG. 10.

FIG. 11 is a diagram illustrating a variation of the heat dissipator illustrated in FIG. 10. In a heat dissipator 18-2A illustrated in FIG. 11, the position of the leeward end surface 20*d* of the flat surface portion 20*a* in the Z axis direction is on the windward side relative to the position of the leeward end surfaces 21*d* of the fins 21 in the Z axis direction. Therefore, in the heat dissipator 18-2A, a part of the end surface 211 of the fins 21 on the leeward side is not covered by a deflector plate 20A. When the deflector plate 20A is formed in such a manner, the amount of material used to form the deflector plate 20A is reduced as compared to the heat dissipator 18-2 illustrated in FIG. 10, whereby the cost of manufacturing the heat dissipator 18-2A can be reduced.

Moreover, according to the heat dissipator 18-2A, a part of the end surface 211 of the fins 21 communicates with the region R having the pressure lower than the pressure of the closed space F, so that the velocity of flow of the air flowing from the inlet 24 to the outlet 25 of the heat dissipator 18-2A can be further increased, and that the cooling efficiency of the electric components 17 in contact with the heat dissipator 18-2A is further improved.

Note that any of the deflector plates 20 and 20A illustrated in FIGS. 10 and 11 can also be combined with the heat dissipator 18-1 or the heat dissipator 180 illustrated in FIGS. 8 and 9. Moreover, although the first and second embodiments have described the example of the configuration in which the control substrate 16 is arranged to extend horizontally, the direction of extension of the control substrate 16 is not limited to the horizontal direction, and may be a direction slightly tilted from the horizontal direction or may be a vertical direction as long as the electric components 17 provided on the control substrate 16 can be cooled. Moreover, the outdoor units 1-1 and 1-2 of the first and second embodiments can each be used as an outdoor unit of a device other than the air conditioner such as a heat pump water heater.

Furthermore, in the first embodiment, the outdoor unit 1-1 when viewed from the front is provided with the blower chamber 11 on the left side and the compressor chamber 12 on the right side, but the outdoor unit 1-1 may be provided with the compressor chamber 12 on the left side and the blower chamber 11 on the right side. The similar applies to the outdoor unit 1-2 according to the second embodiment.

Third Embodiment

Figure 12:
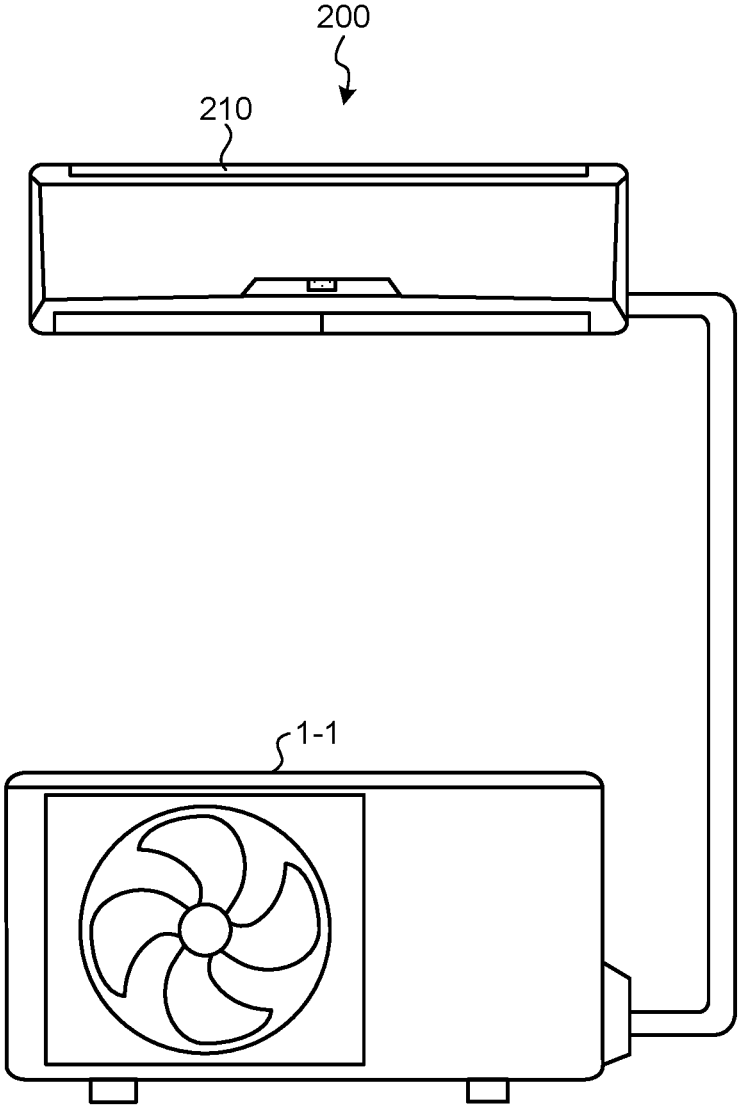
FIG. 12 is a diagram illustrating an example of a configuration of an air conditioner according to a third embodiment of the present invention.

FIG. 12 is a diagram illustrating an example of a configuration of an air conditioner according to a third embodiment of the present invention. An air conditioner 200 includes the outdoor unit 1-1 according to the first embodiment and an indoor unit 210 connected to the outdoor unit 1-1. The use of the outdoor unit 1-1 according to the first embodiment can provide the air conditioner 200 in which the housing 2 can be downsized while improving the cooling efficiency of the heat dissipator 18-1 illustrated in FIG. 2 and the like. Moreover, with the improved cooling efficiency of the heat dissipator 18-1, the air conditioner 200 having high reliability can be provided. Note that the air conditioner 200 may be combined with the outdoor unit 1-2 according to the second embodiment instead of the outdoor unit 1-1 according to the first embodiment.

The configuration illustrated in the above embodiment merely illustrates an example of the content of the present invention, and can thus be combined with another known technique or partially omitted and/or modified without departing from the scope of the present invention.

The invention claimed is:

1. An outdoor unit comprising:

a housing that includes a front panel having an outlet for an airflow, a back panel facing the front panel, a left side panel, a right side panel facing the left side panel, a bottom panel, and a top panel facing the bottom panel;

a bell mouth that has an annular shape, is provided on the front panel, and projects from a rim of a circular opening forming the outlet;

a control substrate that is provided in the housing and provided with an electric component; and a heat sink that is placed at a position in the housing not overlapping the circular opening when viewed from a front of the front panel, and dissipates heat generated by the electric component, wherein a windward end surface and a leeward end surface of the heat sink are, when viewed from above the top panel, placed in a region between a plane and the back panel, the plane including an end of the bell mouth on a side of the back panel and being parallel to an inner surface of the front panel, wherein the control substrate is entirely housed in an electric component box, the electric component box is provided over a partition board that partitions a space in the housing and the electric component box is provided between an upper end of the partition board and the top panel, and an end surface of the electric component box facing the back panel is provided between the back panel and the plane.

2. The outdoor unit according to claim 1, wherein the electric component is a semiconductor element including a wide bandgap semiconductor.

3. An air conditioner comprising the outdoor unit according to claim 1, and an indoor unit.

4. The outdoor unit according to claim 1, wherein the heat sink includes a base having a plate shape, and a plurality of fins provided on the base, and the base has a width along a direction from the front panel to the back panel narrower than a width along a direction from the right side panel to the left side panel.

5. The outdoor unit according to claim 4, wherein a plurality of the electric components are provided on the control substrate, and the heat sink is formed such that a first fin pitch in a direction of arrangement of a plurality of the fins provided corresponding to a first electric component among the plurality of the electric components is narrower than a second fin pitch in the direction of arrangement of a plurality of the fins provided corresponding to a second electric component, the first electric component having the highest amount of heat generated, and the second electric component having a lower amount of heat generated than the amount of heat generated by the first electric component.

6. The outdoor unit according to claim 4, further comprising a deflector plate provided to the heat sink, wherein the deflector plate includes:

a first guide piece that guides an airflow generated inside the housing to an inlet formed by the windward end surface of the heat sink; and a second guide piece that is connected to the first guide piece, is provided at ends of a plurality of the fins, and guides air introduced into an air passage surrounded by the base and the fins to an outlet that is formed by the leeward end surface of the heat sink.

7. The outdoor unit according to claim 6, wherein an end of a leeward end surface of the second guide piece is located on a windward side relative to the leeward end surface of the heat sink.

8. The outdoor unit according to claim 4, wherein the plurality of the fins is arranged apart from one another in the direction from the right side panel to the left side panel, a plurality of the electric components are provided on the control substrate, and the plurality of the electric components is arranged on the control substrate apart from one another in the direction from the right side panel to the left side panel, and the plurality of the electric components is thermally connected to the base.

9. The outdoor unit according to claim 8, wherein the heat sink is formed such that a first fin pitch in a direction of arrangement of a plurality of the fins provided corresponding to a first electric component among the plurality of the electric components is narrower than a second fin pitch in the direction of arrangement of a plurality of the fins provided corresponding to a second electric component, the first electric component having the highest amount of heat generated, and the second electric component having a lower amount of heat generated than the amount of heat generated by the first electric component.

10. The outdoor unit according to claim 8, further comprising a deflector plate provided to the heat sink, wherein the deflector plate includes:

a first guide piece that guides an airflow generated inside the housing to an inlet formed by the windward end surface of the heat sink; and a second guide piece that is connected to the first guide piece, is provided at ends of a plurality of the fins, and guides air introduced into an air passage surrounded by the base and the fins to an outlet that is formed by the leeward end surface of the heat sink.

* * * * *